US008881921B2

(12) United States Patent
Mallochet et al.

(10) Patent No.: US 8,881,921 B2
(45) Date of Patent: Nov. 11, 2014

(54) PART-SPHERICAL SLIDING SURFACE DISPENSING BOTTLE-TOP FOR PRODUCTS OF LIQUID OR VISCOUS CONSISTENCY AND BOTTLE FITTED WITH SUCH A BOTTLE-TOP

(75) Inventors: Cédric Mallochet, Bezons (FR); Olivier Perrin, Chatillon (FR); Gilles Hengy, Hirsingue (FR); Jean-Jacques Wicky, Blotzheim (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 0 days.

(21) Appl. No.: 13/518,830

(22) PCT Filed: Dec. 21, 2010

(86) PCT No.: PCT/IB2010/055989

§ 371 (c)(1), (2), (4) Date: Sep. 24, 2012

(87) PCT Pub. No.: WO2011/077378

PCT Pub. Date: Jun. 30, 2011

(65) Prior Publication Data

US 2013/0008866 A1 Jan. 10, 2013

(30) Foreign Application Priority Data

Dec. 24, 2009 (FR) ..... 09 59594

(51) Int. Cl.

| | |
|---|---|
| ***B65D 47/00*** | (2006.01) |
| ***B65D 47/30*** | (2006.01) |
| ***B65D 47/26*** | (2006.01) |
| ***B65D 47/20*** | (2006.01) |

(52) U.S. Cl.

CPC ..... *B65D 47/305* (2013.01); *B65D 47/268* (2013.01); *B65D 47/2006* (2013.01)

USPC ..... 215/235

(58) Field of Classification Search

USPC ..... 215/235; 220/254.1, 345.1; 222/536, 222/534, 484

See application file for complete search history.

(56) References Cited

U.S. PATENT DOCUMENTS 3,734,359 A 5/1973 Waterman (Continued)

FOREIGN PATENT DOCUMENTS

| | | |
|---|---|---|
| DE | 3300190 A1 | 5/1984 |
| EP | 0386475 A1 | 9/1990 |
| GB | 1094588 | 12/1967 |
| GB | 2295385 A | 5/1996 |

(Continued)

OTHER PUBLICATIONS

International Search Report for International Application No. PCT/IB2010/055989, dated Mar. 30, 2011.

*Primary Examiner* — Anthony Stashick
*Assistant Examiner* — Ernesto Grano
(74) *Attorney, Agent, or Firm* — Hunton & Williams LLP

(57) ABSTRACT

A dispensing bottle-top 10 for bottles for products of liquid or viscous consistency includes a bottle-top body (20) adapted to be mounted on a bottle and including a feed cavity (13) and a top piece (30) adapted to be moved relative to this body between an inactive configuration in which a product dispensing orifice (35) is blocked and an active configuration in which this dispensing orifice (35) is exposed to the outside and communicates with the feed cavity (13). This bottle-top has a lateral wall that is advantageously cylindrical and is formed by the body 20 and, in said inactive configuration, an upper wall consisting entirely of the upper wall of the top part 30. This cylindrical body and this top part have complementary part-spherical surfaces adapted to slide one along the other with a relative movement and being connected by complementary retaining and guiding elements that remain hidden by this top part in each of the active and inactive configurations thereof. The dispensing orifice 35 is in one of the sliding surfaces.

14 Claims, 5 Drawing Sheets

(56) References Cited

U.S. PATENT DOCUMENTS

| | | | | |
|---|---|---|---|---|
| 5,054,662 | A * | 10/1991 | Santagiuliana | 222/531 |
| 6,053,374 | A * | 4/2000 | Santagiuliana | 222/534 |
| 6,478,194 | B2 * | 11/2002 | Haglund et al. | 222/153.14 |

FOREIGN PATENT DOCUMENTS

| | | |
|---|---|---|
| WO | WO 95/ 11172 | 4/1995 |
| WO | WO 02/ 32776 | 4/2002 |
| WO | WO 2004/ 071882 A2 | 8/2004 |

* cited by examiner

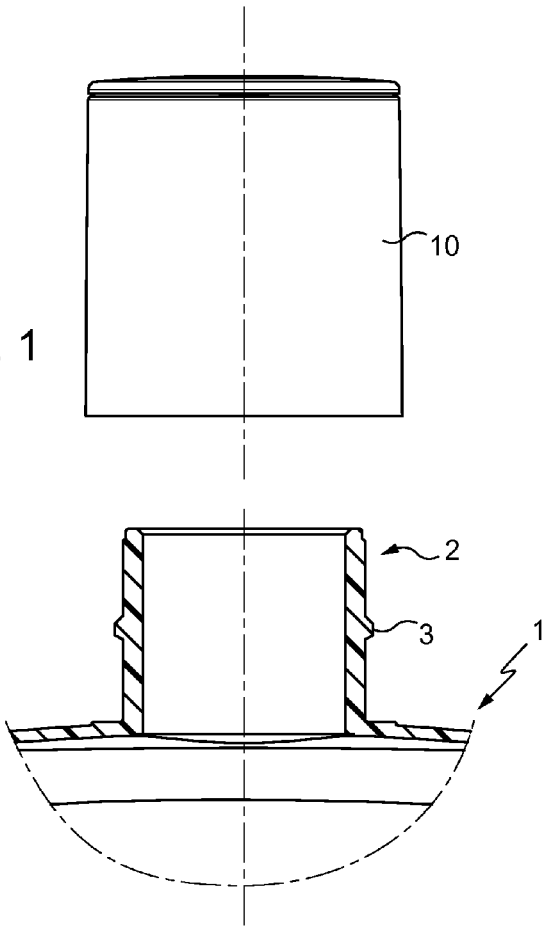
Fig. 1
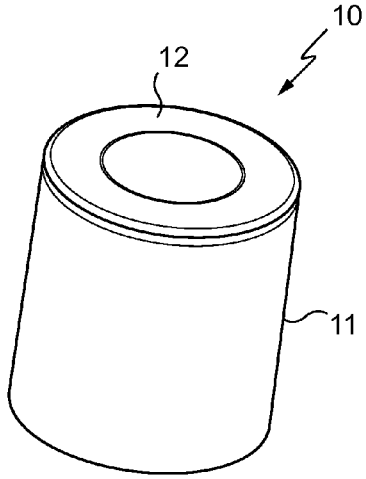
Fig. 2
Fig. 3
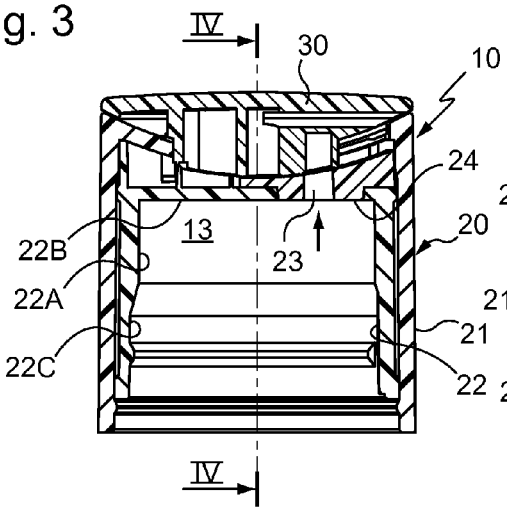
Fig. 4
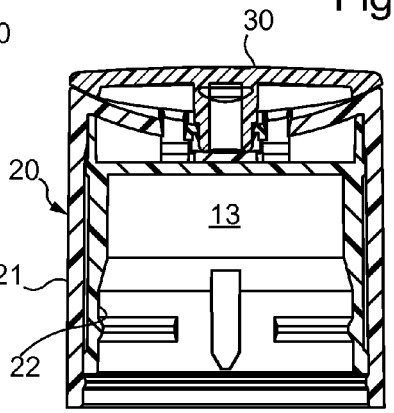

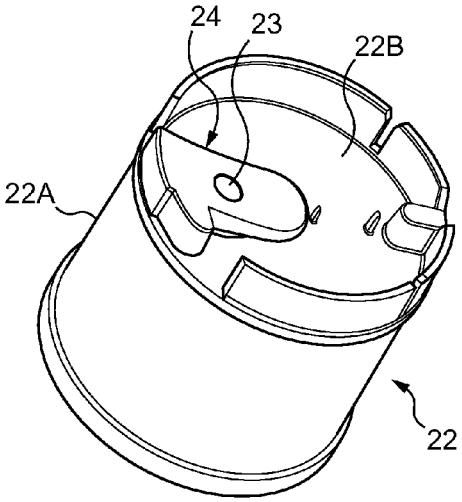
Fig. 5
Fig. 6
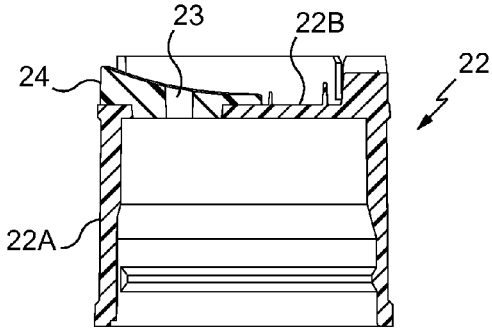
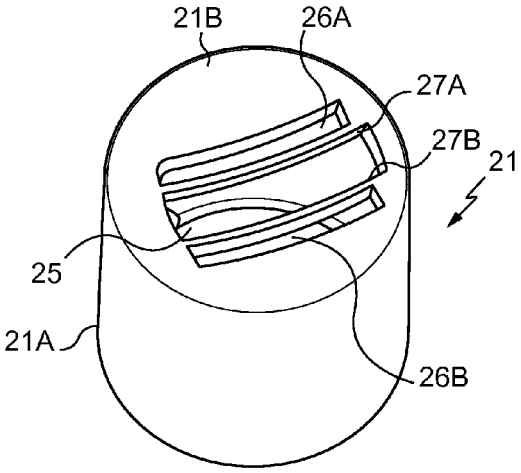
Fig. 7
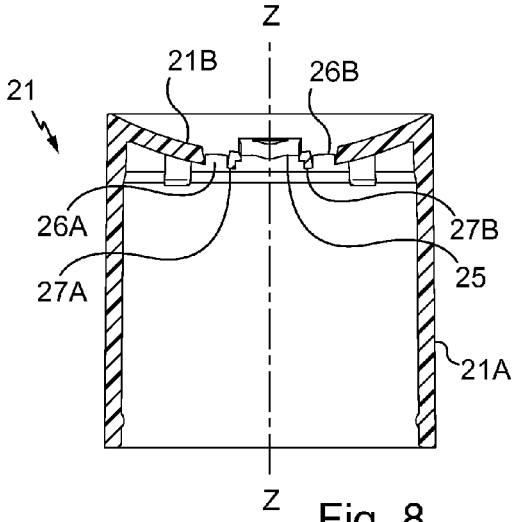
Fig. 8
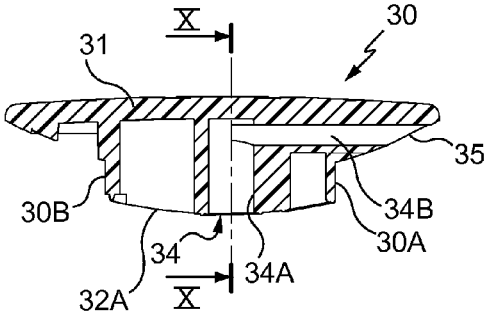
Fig. 9
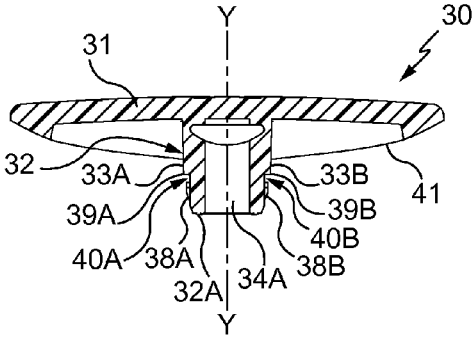
Fig. 10

PART-SPHERICAL SLIDING SURFACE DISPENSING BOTTLE-TOP FOR PRODUCTS OF LIQUID OR VISCOUS CONSISTENCY AND BOTTLE FITTED WITH SUCH A BOTTLE-TOP

CROSS-REFERENCE TO RELATED APPLICATIONS

This application is the U.S. National Phase of International Application No. PCT/IB2010/055989 filed on Dec. 21, 2010, which claims priority to French Application No. FR 0959594, filed Dec. 24, 2009.

FIELD OF THE INVENTION

The invention concerns a dispensing bottle-top. It is notably directed to a bottle-top for dispensing products of liquid or viscous consistency contained in a bottle; such products may often flow by gravity alone. The invention is aimed more particularly at dispensing products in the cosmetics field, or even the pharmaceuticals or foodstuffs field, namely products typically contained in bottles with bottle-tops that have a transverse dimension of hardly a few centimeters (typically at most equal to 3 cm, or even 2 cm).

The invention also concerns a bottle equipped with such a bottle-top.

BACKGROUND

Diverse bottle-top structures are known already that enable the dispensing of products contained in bottles on the neck of which such bottle-tops are mounted (in practice screwed or clipped). In an inactive configuration the bottle-top resembles an ordinary top whereas in the active dispensing configuration an upper portion of the bottle-top is moved to enable the product to exit via an exit orifice. Diverse types of structures may be distinguished.

There is known from the document DE-33 00 190 (Zeller Plastik) published in 1984 a bottle-top including a body and part of the top of which is formed of a narrow piece radially mobile in translation between a rest configuration in which a passage through the body is isolated from a dispensing passage contained in the mobile part of the top of the bottle-top and an active configuration in which the feed passage and the distribution passage are in communication with this mobile part then projecting radially relative to the body. The outside surface of this bottle-top is complicated, being conjointly formed by the mobile part, a deformable part covering the front part of the mobile part in the area in which it moves, and lateral parts between which the previous two parts slide.

There are further known from the document WO-95/11172 (Zeller Plastik) published in 1995 various bottle-top structures including a body intended to be mounted on the neck of a bottle and a cap at the top pivotable about a substantially diametrical axis between an inactive configuration in which a dispensing passage contained in the cap top is isolated from a feed passage and an active configuration in which these passages are in communication. In an inactive configuration the cap is engaged inside a lateral skirt of the body that surrounds it over most of its periphery (except for a notched area enabling the application of an axial thrust to cause it to pivot toward the active configuration). The existence of this skirt is necessary in particular to enable the provision of the pivot axis.

In the document WO-2004/071882 (Poly-Seal Corp), the bottle-top includes a bottle-top body engaged on the neck of a bottle and a cap mounted to pivot on the body. The bottle-top body includes a feed passage that communicates at all times with the inside of the bottle (thus with the bottom part of the body) while the cap includes a dispensing passage (leading to an outlet orifice); in an inactive (or closed) configuration, the cap of the bottle-top is in a configuration relative to the body in which the dispensing passage is isolated from the bottle-top body passage whereas, in the active (or open) configuration, the cap of the bottle-top is in a configuration relative to the body in which the dispensing passage is in communication with the feed passage. The change in the configuration of the cap between its two configurations is obtained by axial pressure for example with a finger, so as to cause the cap to pivot. Also, the cap is rotatable about the axis of the body between an angular position in which the pivoting movement is possible and a position in which the pivoting movement is rendered impossible. In an inactive configuration, this cap is disposed transversely to the axis of the bottle-top body and surrounded over most of its periphery by a lateral skirt of the bottle-top body (the product outlet orifice is concealed by this skirt); pivoting of this cap is reflected in an inclination relative to the axis. Clearly the presence of the skirt as far up as the periphery of the bottle-top at the level of its upper surface is necessary to enable on the one hand the provision of the pivot axis (it must be able to turn about the axis) and on the other hand to mask properly the outlet orifice in an inactive configuration.

Instead of providing the bottle-top body with a cap that slides in a linear fashion or pivots, it has also been proposed to provide a cap adapted to slide along a curved trajectory of circular arc shape.

Thus the document WO-02/32776 (Crown Cork & Seal Technologies Corp) published in 2002 discloses a bottle-top for a container including a cap body intended to be mounted on the neck of a container and a narrow top part diametrically mobile on the body along a trajectory of circular arc shape between an inactive configuration in which a dispensing passage contained in this narrow part is isolated from a feed passage formed in the body whereas its outlet orifice is blocked and an active configuration in which the feed and dispensing passages are in communication with each other while the outlet orifice is exposed. It is stated that one advantage of the arcuate shape of the translation trajectory is that the movement of the narrow top part makes it possible for the curved surface on which the translation is effected to block or to expose the outlet orifice, at the same time as enabling easy dispensing of the product in the open configuration. However, as mentioned above, it should be noted that the top part that is mobile is narrow, which appears necessary to provide for implanting hooks at the base of the flanks of this mobile part, at the same time as providing slots in the body to receive the hooks as well as enabling a curved travel in translation sufficient to enable clear differentiation of the active and inactive configurations.

It is apparent that the known solutions are complex (from the structural point of view, and even from the use point of view) and that their structure is often visible, to the point of possibly degrading the esthetics of the bottle-top concerned.

SUMMARY OF THE INVENTION

The invention aims to provide a dispensing bottle-top for bottles of products of liquid or viscous consistency combining a cleaner esthetic (by making the separations between the component parts as imperceptible as possible), both in the closed configuration and in the open configuration, with good ergonomics (in particular manipulation by one finger), within transverse dimensions of barely a few centimeters, and with highly reliable mechanical guidance (notably without unwanted rotation). The invention advantageously aims to provide a good seal between the inside of the bottle and the outside proof against liquids or even proof against air (to achieve a long product shelf life).

To this end the invention proposes a dispensing bottle-top for bottles for products of liquid or viscous consistency, including a bottle-top body adapted to be mounted on a bottle and including a feed cavity and a top piece adapted to be moved relative to this body between an inactive configuration in which a product dispensing orifice is blocked and an active configuration in which this dispensing orifice is exposed to the outside and communicates with the feed cavity, characterized in that this bottle-top has a lateral wall formed by the body and, in said inactive configuration, an upper wall consisting entirely of the upper wall of the top part, this body and this top part having complementary part-spherical surfaces, respectively concave and convex, adapted to slide one along the other with a relative movement and being connected by complementary retaining and guiding elements that remain hidden by this top part in each of the active and inactive configurations thereof.

Clearly, since the top part occupies the whole of the upper surface of the bottle-top and the lateral wall of this bottle-top is formed by the bottle-top body, the separation between this body and this top part is situated substantially at the junction of these upper and lateral surfaces, so that it is hardly visible; this line of separation is in the immediate vicinity of this junction if this junction is a circle but remains hardly visible if this junction has a contour close to a circle, for example a square with very rounded corners, an oval, etc. In addition to a cleaner esthetic, this bottle-top is ergonomic in use because transverse movement of one finger is sufficient to move the top part between its active and inactive configurations.

It is thus clear that the junction between the lateral and upper walls preferably has a circular contour, the lateral wall advantageously being a circular cylinder or even a frustoconical cylinder with a small cone angle (with a half-angle at the apex typically less than 20°).

The concave sliding surface of the body advantageously includes a main slot having a plane of symmetry and the top part includes two parallel flanks projecting relative to this convex sliding surface and symmetrical with respect to the plane of symmetry of the main slot, these flanks being provided with clipping detents (or transverse slots) for engaging and retaining these flanks in this main slot, the dimension of this main slot along its plane of symmetry being such that this main slot remains hidden by the top part in each of the inactive and active configurations of the top part, the dispensing orifice being in one of the sliding surfaces and symmetrical with respect to the plane of symmetry of the main slot.

The fact that the body includes a slot while the top part is provided with two parallel flanks that slide in this slot guarantees efficacious guiding of the top part at the same time as maintaining its angular orientation relative to the axis. Finally, because the slot has dimensions such that it remains hidden in each of the positions of the top part, the esthetic of the bottle-top is preserved in any configuration thereof.

Clearly the slots may not be rectilinear in cross section if the movement to be obtained is curved as a function of the right or left hand of the user acting on the top part, for example.

Blocking a dispensing orifice by means of a part mobile in translation along a curved trajectory has already been proposed in the document GB-1 094 588 (Bettix Ltd) published in 1967. To be more precise, that document describes a globally cylindrical canister the upper wall of which includes a highly localized depressed area formed of a part-spherical cup in which a slot and an opening are formed. Along the surface of this depression is mounted a convex part of saucer shape that is mobile in translation along this surface, being guided by a simple finger of circular section passing through the slot; depending on whether the convex part occupies the volume of the depression or not, it blocks or exposes the opening and enables or prevents pouring of the material (in principle powder) in the container via the opening, sliding along the convex part (which can thus act as a pourer spout). Note that, in is inactive configuration, the convex part is substantially flush with the upper wall of the canister.

However, it should be noted that the above document is in no way concerned with cosmetic products (it mentions cooking salt or detergent) and does not relate in any way to a bottle-top that can be mounted on a bottle and has a lateral wall and an upper wall; furthermore, the above document is in no way concerned with esthetics.

In a complementary way, the above document is in no way concerned with angular positioning of the convex part, whereas this may be one of the esthetic constraints addressed by the invention (notably if it is required to place a logo on the outside surface of the cap and to guarantee that in use this logo retains a given orientation relative to the bottle and thus relative to the rest of the cap.

According to other advantageous features of the invention, where applicable in combination:

- the main slot is flanked by two secondary slots defining with said main slot two flexible guide rails for the flanks of the top part; such flexibility contributes to retaining the top part properly relative to the body,
- bridges of material may be provided across the secondary slots, which makes it possible to control the flexibility parallel to or transversely to the axis,
- the flanks include shoulders facing the detents to define grooves for receiving the edges of the main slot; this ensures correct positioning of the edges of the slot relative to these flanks,
- the sliding surfaces have radii of curvature between half and twice the average width of the top part (its diameter in the case of a circular contour); this corresponds to easy sliding,
- the main slot has a length of at least two thirds the diameter of the top part; this makes it possible to uncover a sufficient portion of the sliding surface in which the dispensing orifice is provided to expose that orifice effectively,
- the active and inactive configurations of the top part relative to the bottle-top body are determined by complementary bearing surfaces that are advantageously situated near the sliding surfaces coming into abutting engagement; this makes it possible to confer a compact shape on the top part,
- the bottle-top body includes a ramp adapted to be flanked by the flanks of the top part when it moves between the active and inactive configurations which contributes to good isolation of the dispensing orifice from the inside of the bottle-top body; it is especially preferable for the ramp to be part of a part molded over an inside part of the bottle-top body, this inside part being engaged in an outside part of this body, this outside part and the top part determining the outside surface of the bottle-top; this makes it possible to choose a plurality of materials to combine esthetics and effective sealing.

In a first embodiment of the invention, the dispensing orifice is in the sliding surface of the top part, this top part including a dispensing passage terminating at this dispensing orifice and configured to communicate selectively with the feed cavity of the body depending on whether the top part is in its active configuration or in its inactive configuration.

The bottle-top body preferably includes a feed passage that is offset relative to the axis of this body and the feed passage of the top part preferably discharges in an area offset from the axis of this top part.

In another embodiment of the invention the dispensing orifice is in the sliding surface of the body, the sliding movement of the top part relative to the body being in the opposite direction to the movement of that orifice relative to the axis of the body.

The invention further proposes a bottle fitted with a dispensing bottle-top of the type referred to above, with or without the advantageous optional features referred to above.

BRIEF DESCRIPTION OF THE FIGURES

Objects, features and advantages of the invention emerge from the following description given by way of illustrative and nonlimiting example and with reference to the appended drawings, in which:

FIG. 1 is an elevation view of a dispensing bottle-top of a first embodiment of the invention on the point of being engaged on the neck of a bottle represented in axial section, FIG. 2 is a perspective view of this dispensing bottle-top, FIG. 3 is a view of the dispensing bottle-top in axial section on a section plane intercepting a dispensing orifice, FIG. 4 is a view in axial section on the section plane IV-IV in FIG. 3, FIG. 5 is a perspective view of an inside part of the cylindrical body of the dispensing bottle-top, FIG. 6 is a view of it in axial section, FIG. 7 is a perspective view of an outside shroud of this cylindrical body of the cylindrical bottle-top, FIG. 8 is a view of it in axial section on a section plane transverse to the main slot, FIG. 9 is a view of the top part in axial section on a section plane intercepting the dispensing orifice, FIG. 10 is a view of it in section on the section plane X-X in FIG. 9.

DETAILED DESCRIPTION OF PREFERRED EMBODIMENTS

Figure 14:
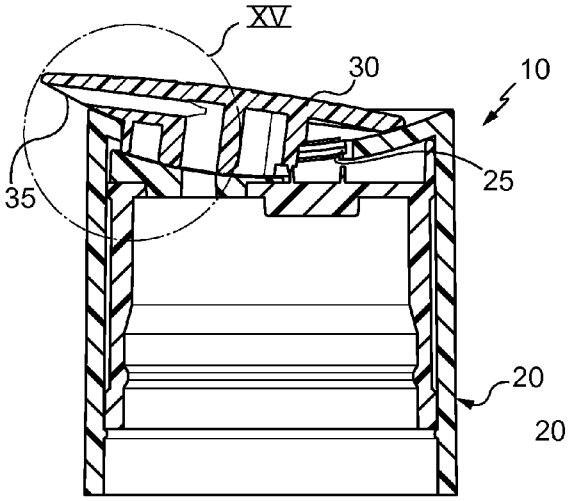
FIG. 14 is a view in axial section of this bottle-top in an active configuration.

FIGS. 1 to 15 conjointly represent a dispensing bottle-top of a first embodiment of the invention and FIGS. 16 to 23 represent another embodiment of the invention. The main difference between the dispensing bottle-tops that are represented in the figures is the position of the dispensing orifice enabling a liquid or viscous cosmetic product to flow through this dispensing bottle-top, for example by gravity alone. The product concerned may alternatively be a food or pharmaceutical product of liquid or viscous consistency. Another alternative is for the flow of the product to result from pressure exerted on a flexible bottle on which this kind of bottle-top of the invention is mounted.

FIG. 1 represents a dispensing bottle-top 10 on the point of being engaged on the neck 2 of a bottle 1 of cosmetic product. This engagement may be of any kind, as required. Here the bottle-top is intended to be a snap fit on the neck of the bottle; to this end a circumferential rib 3 is provided to couple the bottle-top to the bottle; lugs that are not shown may further be provided for angularly indexing the bottle-top relative to the bottle. The bottle-top may alternatively be screwed onto the neck of the bottle.

As is clear from FIG. 2, the bottle-top here has a circular cylindrical shape, with a cylindrical lateral surface 11 and an upper surface 12 transverse to the axis. The lateral surface may instead be flared with a frustoconical shape, for example with a half-angle of about 20°; this lateral surface may equally be cylindrical in the geometrical sense of that term, i.e. have a constant section, for example rectangular with rounded corners. It will nevertheless be understood hereinafter that the circular cylinder shape has the advantage of enabling good masking between the component parts of the bottle-top.

As emerges from the following figures, this cylindrical lateral surface and this upper surface are formed on different parts coupled together and provided with complementary guide elements.

Thus it is seen in FIGS. 3 and 4 that the dispensing bottle-top 10 comprises two parts:

- a cylindrical body 20, here including an outside part 21 and an inside part 22, and
- a top part 30, also called its cap.

The cylindrical body 20 of the bottle-top 10 includes a main cavity (called the feed cavity) 13 delimited here by the inside part 22.

This inside part 22 is represented in more detail in FIGS. 5 and 6. It is produced in any appropriate material, notably in a thermoplastic material such as polyethylene (PE), polypropylene (PP) or any other appropriate material.

This inside part 22 consists primarily of a cylindrical skirt 22A adapted to cap the neck of the bottle and a transverse wall 22B closing off the upper part of this skirt 22A. This cylindrical skirt has an inside geometry enabling good cooperation with the neck of the bottle; because in this example engagement is by way of a snap fastening, the skirt 22A includes internally an annular groove 22C adapted to snap over the rib 3 on the neck 2. A feed passage 23 through the transverse wall 22B enables the spaces on respective opposite sides of this wall to communicate.

This feed passage 23 is advantageously produced through a part 24 that is attached to, for example molded over, the part forming the lateral skirt and part of the transverse wall and has the shape of a ramp that extends from the center of the wall 22B until it is in line with the cylindrical wall 22A (and preferably also widening). This ramp has a part-circular upward-facing concave profile. This part 24 is advantageously produced in an elastomer material molded onto the inside part 22. Alternatively, the ramp may be formed directly on the inside part.

The outside part 21 is represented in more detail in FIGS. 7 and 8. Like the inside part that it fits over, it includes a skirt 21A of circular cylindrical shape and a transverse wall 21B that closes off the section of this skirt in its upper part.

This transverse wall has a concave part-spherical shape centered on the axis Z-Z of the wall. In this concave wall 21B there is formed a main slot 25 advantageously having a plane of symmetry passing through the axis Z-Z and the line of which coincides with the axis Z-Z in FIG. 8. This slot has parallel edges (at least as seen from above).

This main slot is advantageously complemented by secondary slots 26A and 26B disposed on either side of the main slot in an arrangement that is also symmetrical with respect to the plane of symmetry Z-Z. These secondary slots 26A and 26B define with the main slot curved rails 27A and 27B. These rails 27A and 27B are rigid (given the material from which they are made) but also flexible (because of their geometry) and may advantageously be deformed elastically both tangentially to and transversely this concave wall. The benefit of this flexibility will become apparent later. The two edges of the secondary slots may where appropriate be linked locally by bridges of material that control the flexibility of the rails.

The main slot has a front end (on the right in FIG. 7) that is closer to the periphery of the concave walls and a rear end (on the left in FIG. 7); this main slot extends beyond the secondary slots in the direction of this first end, beginning substantially level with the secondary slots. For example, the front end of the main slot is at a distance from the edge of the concave surface that is substantially equal to the thickness of the wall of the outside part of the body. The geometry of the main slot is chosen to enable the required movement of the top part relative to the body and thus depends on the geometry chosen for them.

The outside part 21 is designed to cap the inside part in a configuration in which the main slot 25 extends along the ramp formed by the part 24.

The cylindrical wall 21A of this outside part defines the cylindrical lateral surface 11 of the bottle-top.

FIGS. 9 and 10 represent the top part 30, also called the cap.

This cap includes an upper wall 31 defining the transverse upper surface 12 of the dispensing bottle-top when the latter is in an inactive configuration, i.e. in a rest position. This wall is delimited by a circular edge of substantially the same diameter as the cylindrical wall 21A of the outside part (typically to within ±5%), thanks to which this upper wall covers all of the convex surface 21B of this outside part in said inactive configuration. Alternatively, in the case of a frustoconical lateral wall, said circular edge has substantially the same diameter as the narrow end of the frustoconical wall. If the lateral wall has an upper end having a shape departing from a circle, the top part has a shape approximating as closely as possible that of that upper end.

Here this upper wall 31 is slightly convex, but it may instead be plane or slightly concave, as required (notably from the esthetic point of view, or even from the ergonomic point of view).

This cap further includes, under this upper wall, a cap body 32 with two lateral flanks 33A and 33B that are parallel to and symmetrical with respect to a plane of symmetry Y-Y (FIG. 10). A dispensing passage 34 having a section 34A parallel to the axis and a transverse section 34B passing through a dispensing orifice 35 is provided inside the cap body. The section 34A of the dispensing passage discharges at the base 32A of the cap body 32. This base 32A has a curvature substantially equal to the curvature of the ramp 24 so that it can slide along the ramp 24.

The lateral flanks 33A and 33B are provided near their inside edges along the base 32A with detents 38A and 38B, here of triangular section, having shoulders facing toward the upper part; these detents, which preferably extend along the whole of these lower edges, are advantageously flanked over at least part of their length by shoulders 39A and 39B facing their edges. The detents and the shoulders conjointly define grooves 40A and 40B designed to receive the rails 27A and 27B of the bottle-top body; the grooves 40A and 40B are therefore curved with the same separation and the same curvature as the curved rails 27A and 27B of the outside part of the bottle-top body (approximately equal to the curvature of the attached part 24).

The cap includes opposite the outside surface 12 a convex lower surface 41 that is part of a sphere having substantially the same radius of curvature as the concave surface 21B of the bottle-top body. These surfaces 21B and 41 are designed to slide one on the other.

Figure 15:
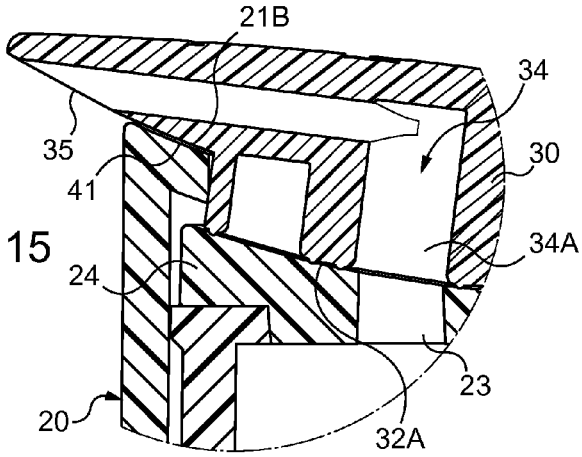
FIG. 15 is a view to a larger scale of the detail XV from FIG. 14.

This lower convex surface has a geometry such that the cap body facing it projects so that it can pass through the slot 25 in the complementary surface 21B of the bottle-top body; FIG. 15 clearly shows that the cooperation between the complementary surfaces 41 and 21B is effected above the sliding surfaces between the base 32A (where the vertical section of the cap dispensing passage discharges) and the attached part 24 (where the feed orifice 23 discharges). This offset is justified by the presence of the detents 38A and 38B all along the base of the cap body. In an alternative that is not shown, the complementary surfaces of the cap body and the attached part may define the same spherical surfaces as the complementary surfaces 21B and 41 if the bottle-top body and the cap are guided (and coupled) laterally and away from the main slot.

This lower convex surface is present at least near the edge of the cap and around the dispensing orifice 35. Outside these areas, the material may be recessed.

The cap body of which the flanks 33A and 33B are part include two end edges; the right-hand edge, see FIG. 9, which is that nearest the dispensing orifice 35, is called the front edge 30A whereas the other edge 30B, on the left in FIG. 9, is called the rear edge.

The cooperation of the various parts described above is clear from FIGS. 11 to 15.

Figure 11:
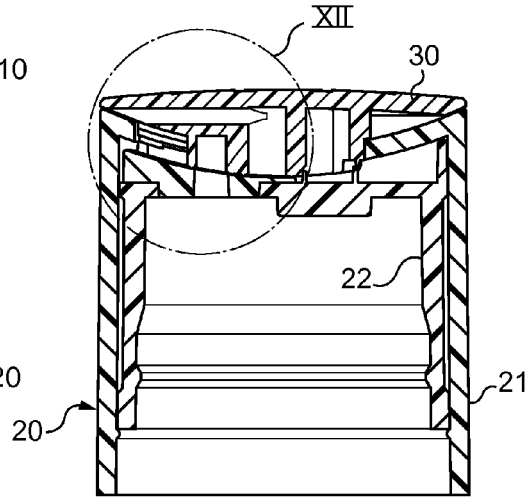
FIG. 11 is a view in axial section of the dispensing bottle-top in an inactive configuration.

In FIG. 11, the inside part 22 and outside part 21 from FIGS. 5 to 8 are assembled together by any appropriate means, for example clipped together, annular beads on one of these parts cooperating with troughs on the other part.

Following this assembly, the ramp 24 of the inside part faces at least the front part of the main slot 25 of the outside part (i.e. the right-hand part of this slot in FIG. 7).

The cap 30 is furthermore mounted on this body by engagement of the flanks 33A and 33B in the main slot until the grooves 40A and 40B are engaged around the rails 27A and 27B, thus retaining and guiding the cap 30 relative to the body 20; this clips the cap into the bottle-top body and guides it along a curved trajectory.

The flexibility of the rails 27A and 27B referred to above facilitates mounting the cap on top of the body. It also enables elastic compression between the cap and the body.

In this assembled configuration, the cap body passes through the main slot and its face rests against the ramp 24.

It is nevertheless clear that cooperation between the cap and the body is possible in the absence of the secondary slots.

Clearly, when the cap is engaged on the bottle-top body, the plane of symmetry Z-Z of the main slot coincides with that Y-Y of the pair of flanks of the cap.

The cap is mobile relative to this body by sliding of the flanks in the main slot, which of course presupposes that this slot is longer than those flanks.

In the configuration referred to hereinabove as the inactive configuration, the cap is coaxial with the body and covers the body exactly (FIGS. 11 to 13), i.e. its upper wall completely masks the concave surface 21B of the body and that concave surface blocks the dispensing orifice. The bottle-top is at rest.

Given that, in the example considered here, the cap 30 has the same diameter as the lateral surface of the body 20, no line of separation is visible from above. In side view (see FIGS. 11 and 12, FIG. 4, and even FIG. 2), a line of separation is perceptible; however, being situated in the immediate vicinity of the top of the bottle-top, it is hardly visible. This is nevertheless not limiting on the invention and the visible part of the cap could alternatively be thicker.

Note that in this configuration the feed passage 23 passing through the inside part discharges facing a blind hole 36 formed in the cap body through its base. The feed passage 23 and the dispensing passage 34 are therefore separate, which encourages good sealed isolation of the inside of the bottle from the outside. Alternatively, the blind hole 36 may be dispensed with, the feed passage simply discharging opposite the base of the cap body.

The dispensing orifice 35 faces a portion of the concave surface 21B situated in front of the front end of the main slot 25 so that it is blocked (the position of the front end relative to the edge of this concave surface must be chosen accordingly).

In this inactive configuration, there is therefore two-fold isolation of the inside of the bottle relative to the outside because the feed passage provided in the bottle-top body is isolated from the dispensing passage and the feed passage is itself isolated from the outside.

The constituent materials of the various parts are advantageously chosen to provide a good seal at the periphery of the various orifices blocked in this way (between the ramp and the convex surface of the cap and between the dispensing orifice and the concave surface of the body).

Figure 12:
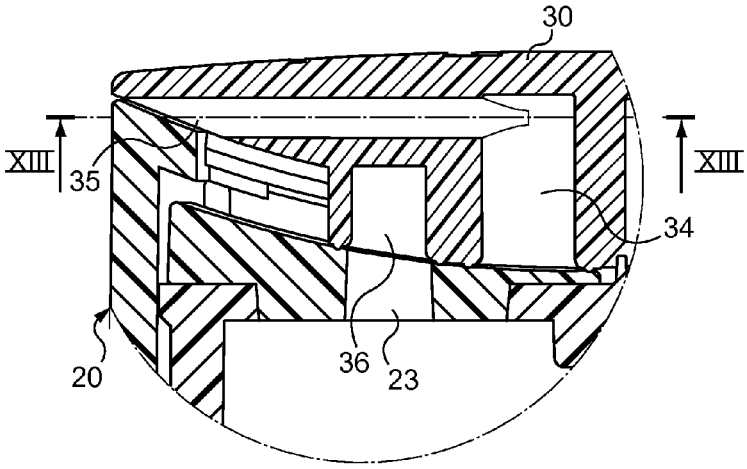
FIG. 12 is a view to a larger scale of the detail XII from FIG. 11.
Figure 13:
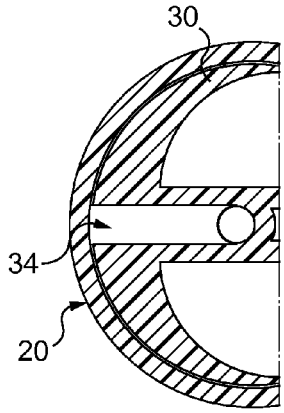
FIG. 13 is a view of this detail in section on the section plane XIII-XIII in FIG. 12.

Clearly the configuration of FIGS. 11 to 13 corresponds to the configuration of FIGS. 1 to 4 in which the bottle-top has a cleaner esthetic, with no truly visible separation between the body and the cap, and in any event without any visible dispensing orifice.

In this inactive configuration, at one end of its movement relative to the bottle-top body a shoulder on the cap body advantageously abuts against a complementary bearing surface of the bottle-top body. For example, this inactive configuration is defined by the rear edge 30B coming into abutting engagement with the rear end of the main slot; alternatively, the cap may include a bearing surface projecting through the main slot toward the inside of the body, while the body includes, under this main slot, a complementary bearing surface defining with the bearing surface of the cap an extreme rearward position in which the cap is in its inactive configuration.

By simply pushing the cap transversely, in practice by means of tangential friction on the outside surface 12, the user may move the cap from its inactive rest configuration of FIGS. 11 to 13 to its active service configuration of FIGS. 14 and 15 (the push is exerted parallel to the plane of symmetry of the main slot and the pair of flanks and toward the front, i.e. in a direction appropriate to moving the pair of flanks toward the front end of the main slot).

The travel of the cap relative to the bottle-top body is sufficient for the dispensing orifice 35 to be exposed vis à vis the concave surface of the bottle-top body. In FIG. 15, the sliding travel of the cap relative to the body is just sufficient for this dispensing orifice to be completely exposed.

The sliding travel of the cap (and thus the movement relative to the inactive rest configuration) is defined by complementary elements coming into abutting engagement; this may be abutting engagement of a front wall (here the edge 30A) of the pair of flanks against the front end of the main slot.

In the active configuration shown in FIGS. 14 and 15, the axial section 34A of the dispensing passage comes into alignment with the feed passage 23 of the ramp 24 so that the dispensing passage 34 is in communication with the main feed cavity 13 and thus with the inside of the bottle. However, the surface of the base 32A of the cap body that surrounds the mouth of the dispensing passage 34A rests against the ramp 24 so that there is an effective seal between the ramp and the base of the cap. In this regard, the stiffness of the rails along which the flanks of the casket slide may be exploited to cause some axial pressure of the cap against the ramp to strengthen this seal.

To strengthen the seal between the bottle-top body and the cap additional thickness may alternatively be provided near the orifices to be brought face to face. Note that such additional thicknesses may have the advantage of constituting a sticking point in the movement relative to the bottle-top body imposed on the cap. Such a sticking point may be provided in any appropriate manner in each of the active (service) and inactive (rest) configurations.

Clearly if the bottle-top from FIGS. 14 and 15 is inclined toward the left and downward, the content of the passage 34 may flow out of the bottle-top by gravity alone; alternatively, this flow may result from pressure exerted on the bottle if it is deformable, for example.

The rigidity (or "stiffness" since there is some flexibility) of the guide rails of the flanks of the cap also contributes to the effective sealing of the dispensing orifice during such reverse movement.

By analogy with the above remarks on the movement toward the active configuration, this reverse movement may be obtained by transverse friction applied by one finger.

Clearly this possibility of displacement by transverse friction exists whether the outside upper surface of the cap is convex, plain or concave.

Clearly the only part of the inside surface of the cap that may be seen in the active service configuration is a crescent-shaped convex surface situated around the dispensing orifice and that, in this active configuration, the only part of the concave surface of the bottle-top body that may be seen is a crescent-shaped surface that is uncovered by the sliding of the cap. These surfaces are advantageously continuous, with no discontinuities because of the main or secondary slots. A cleaner esthetic is thus preserved in each of the active and inactive configurations of the cap and between them.

The ease with which the user is able to maneuver the cap of the dispensing bottle-top is clear. This bottle-top thus combines esthetics and ergonomics as well as, given the aforementioned advantageous features, a good seal.

FIGS. 16 to 23 represent a dispensing bottle-top of another embodiment of the invention.

The elements of this other bottle-top that correspond to elements of that from FIGS. 1 to 15 are denoted by reference numbers that are deduced from those used in FIGS. 1 to 15 by adding 100.

The main difference between the two dispensing bottle-tops is that in the embodiment of FIGS. 1 to 15 the dispensing orifice 35 is carried by the cap whereas in the embodiment of FIGS. 16 to 24 it is carried by the bottle-top body. Consequently, whereas in the first embodiment the movement of the cap into the active service configuration is on the side where the product is required to flow in the second embodiment this movement is away from the side where the product will flow. In all cases, however, this orifice 35 or 135 is blocked when the cap is in its inactive rest configuration and exposed when the cap is in its active service configuration.

Figure 20:
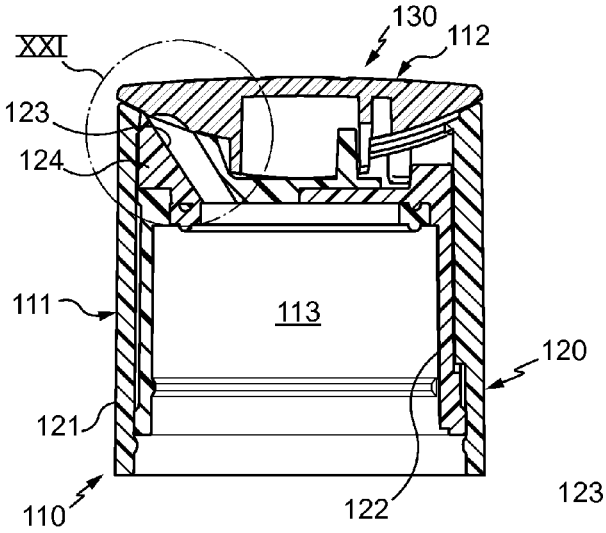
FIG. 20 is a view in section of this other dispensing bottle-top in an inactive configuration.
Figure 23:
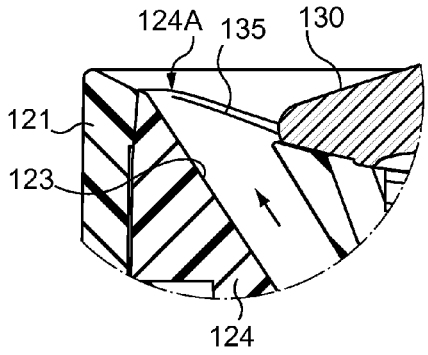
FIG. 23 is a view to a larger scale of the detail XXIII from FIG. 22.

To be more precise, the body of the bottle-top 110 from FIGS. 20 and 23 includes an inside part 122 defining a main feed cavity 113 and an outside part 121 having a lateral surface 121A that is advantageously a circular cylinder (constituting the lateral surface 111 of the bottle-top 110) and a concave surface 121B forming the top of the body 110.

Figure 16:
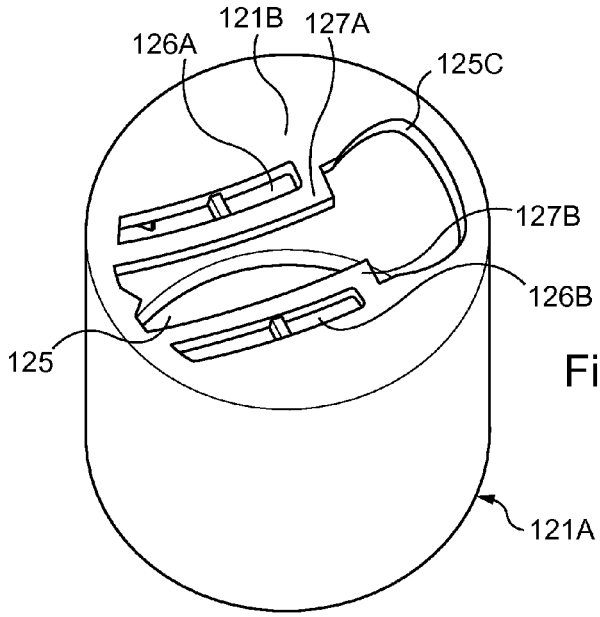
FIG. 16 is a perspective view of the shroud of the cylindrical body of a dispensing bottle-top of another embodiment of the invention.

FIG. 16 shows this outside part 121. Note that the concave surface 121B is provided with a main slot 125 bordered by secondary slots 126A and 126B to form bands of material 127A and 127B forming guide rails and that ridges of material may be provided in the middle of the secondary slots to increase the stiffness of the rails 127A and 127B delimited by these slots.

The right-hand end 125C of the main slot is here significantly wider than the rest of the main slot.

The inside part 122 is similar to that from FIGS. 5 and 6 except that the feed passage 123, preferably formed in a molded-on part 124, is advantageously inclined outward so as to diverge from the axis of the body and its mouth, in the ramp-shape upper surface of this part 124, constitutes the orifice 135 through which the product contained in the bottle is dispensed in use, where applicable by gravity alone. This is why this ramp-shape upper surface rises across the concave upper wall of the part 121 of the bottle-top body, by way of the widened part 125C of the main slot, so as to be at least flush with the upper surface of this upper wall. The mouth constituting the dispensing orifice 135 is preferably further surrounded by a sealing lip 124A.

As before, the ramp may be formed directly on the inside part of the bottle-top body.

Clearly, unlike the first embodiment, there is no need to provide a dispensing passage in the cap.

Figure 17:
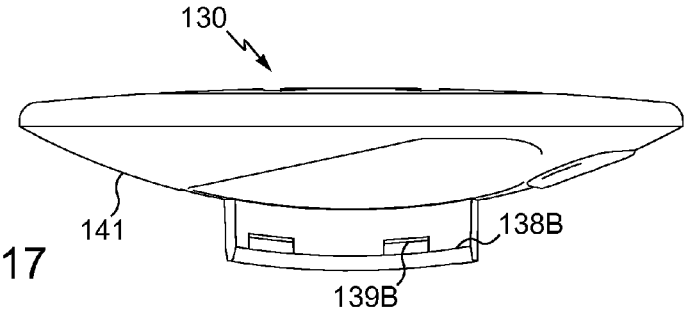
FIG. 17 is a lateral view of the top part of this other dispensing bottle-top.
Figure 18:
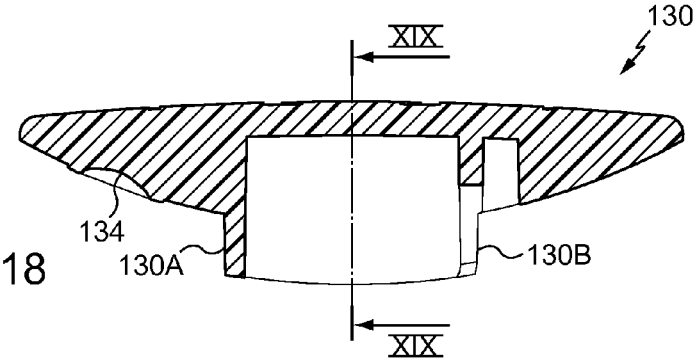
FIG. 18 is a view of this top part in axial section on a section plane parallel to the plane of FIG. 17.
Figure 19:
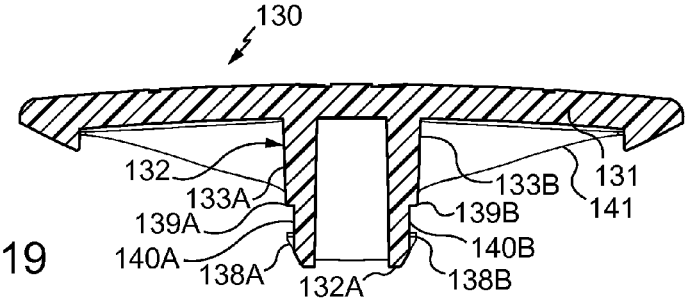
FIG. 19 is a view of this top part in axial section on the section plane XIX-XIX in FIG. 18.

FIGS. 17 to 19 show this cap 130. Like the cap 30 of the first embodiment, it includes an upper wall 131, a convex lower surface 141 and a cap body 132 having flanks 133A and 133B provided along a base 132A with detents 138A or 138B and possibly with shoulders 139A or 139B to delimit curved grooves 140A or 140B adapted to receive the rails 127A or 127B.

The cap body 132 of which the flanks 133A and 133B are part has terminal edges 130A and 130B. In line with this body there is a depression 134 that advantageously accommodates the injection point of the cap. This depression is centered on the dispensing orifice 135 when the cap is in the inactive rest position but its dimensions are preferably significantly less than those of the orifice 135. Other positions of the injection point are also suitable.

Figure 21:
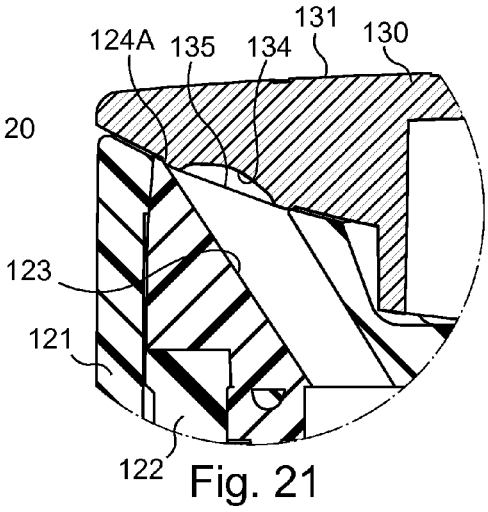
FIG. 21 is a view to a larger scale of the detail XXI from FIG. 20.

FIGS. 20 and 21 represent the second dispensing bottle-top 110 when the cap is in the inactive rest configuration (the inside part 121 is in a configuration turned 180° relative to that from FIG. 16). The appearance of this second bottle-top is identical to that from FIGS. 1 to 4.

Accordingly, seen from above, the upper wall 131 of the cap masks the bottle-top body 110. On the other hand, when the bottle-top is seen from the side, a single separation line is visible between the bottle-top body and the cap in the immediate vicinity of the top of the bottle-top body; this line virtually coincides with the top of the bottle-top formed in this way.

This is not limiting on the invention, however, and the cap may alternatively have in side view a greater thickness, i.e. the line of separation between the cap and the outside part 121 may be closer to the middle of the height of the bottle-top. This line is preferably in the upper half of the bottle-top and even more preferably in the upper third.

The seal between the dispensing orifice 135 and the cap is strengthened by the advantageous presence of the flexible sealing lip 124A, which is compressed all around the dispensing orifice by the cap.

Figure 22:
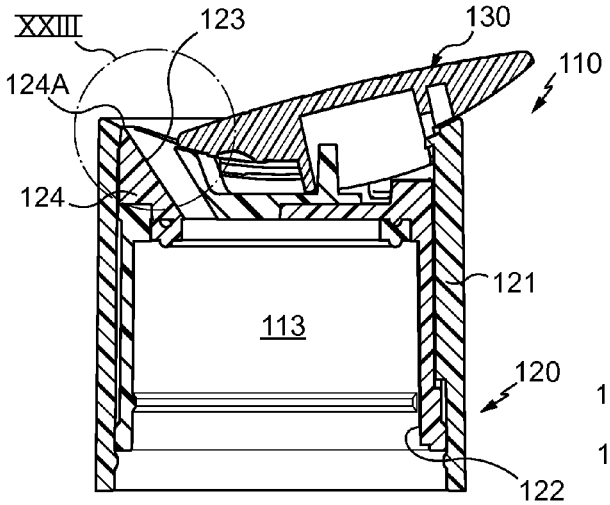
FIG. 22 is a view in section of this bottle-top in an active configuration.

FIGS. 22 and 23 represent this bottle-top in its active service configuration.

It should be noted that, the dispensing orifice 135 being to the left of the axis, as in FIG. 14 (or 15), the movement to be imparted to the cap to expose this orifice is a movement toward the right. This movement is obtained in the same way as in the first bottle-top. As in the first bottle-top, the travel of the cap toward its active service configuration (and reciprocally toward its inactive rest position) is delimited in practice by complementary bearing surfaces on the bottle-top body and on the cap, respectively, coming into abutting engagement (this may be a question of an edge of the cap abutting against a bearing surface of the body).

As explained with reference to FIGS. 14 and 15, the movement of the cap is sufficient to expose the dispensing orifice 135 completely.

Clearly, thanks to the combination of the main slot and the flanks, the cap is coupled axially to the bottle-top body and sliding of the cap is effectively guided along its relative movement between the active and inactive configurations, although there is no visible guide; in other words, effective guidance is obtained without degrading the esthetics or the ergonomics or the seal.

As already indicated, a dispensing bottle-top of the invention is typically intended to be mounted on bottle necks having a diameter of the order of 1 to 3 cm (for example between 2 and 2.5 cm); consequently, the bottle-top advantageously has a diameter between 1.5 and 4 cm (for example of the order of 3 cm); the height of the bottle-top is preferably between ⅔ and 3/2 of this diameter.

The sliding surfaces of the bottle-top body and the cap advantageously have radii of curvature between half and twice the diameter of the bottle-top, for example at least approximately equal to that diameter. These radii are at least approximately equal, but the choice may be made for there to be a slight difference between these radii, typically of a few fractions of a millimeter, for example, to enable axial traction on the guide rails of the flanks of the cap.

The length of the cap body (transversely to its axis) is advantageously at most equal to ⅔ of the diameter of the bottle-top, preferably between ⅓ and ½ that diameter, whereas the slot has a length (measured transversely to the axis of the bottle-top) that is preferably between ⅔ and 9/10 of the diameter of the bottle-top, the travel of the body in the slot being preferably at least equal to ¼ or even ⅓ of the diameter of the bottle-top, so as to expose a sufficient portion of the sliding surface of the cap or of the bottle-top body (depending on whether this refers to the first example or the second example) to locate the dispensing orifice without having to give it a section that is insufficient for good flow of the product in question.

The width of the cap body and thus the width of the main slot is advantageously between 1/10 and 3/10 of this diameter.

The material of the inside part 22 or 122 may be chosen only because of criteria of mechanical strength, cost and compatibility with the formula of the product; it may be a plastic material such as polypropylene, for example (or any other material from the polyolefin family). It is nevertheless beneficial for the ramp 24 or 124 alongside which the lower edge of the body of the cap runs to be in a material (for example an elastomer) having a flexible surface (a rubbery appearance) favorable to obtaining a good seal; the part 24 or 124 is advantageously an insert molded onto the rest of the inside part.

The outside part and the cap are advantageously produced in the same material, chosen for its esthetic qualities, for example a scratch-resistant black plastic material such as a copolyester.

The section of the dispensing passage (whether in the bottle-top body or in the cap) is as large as possible given the dimensions chosen for the bottle-top; it is advantageously elongate (i.e. it may have a transverse width very much less than the transverse length); clearly gravity flow will be all the easier if the section of this passage is large and the viscosity of the product is low. The person skilled in the art will know how to achieve an appropriate compromise between these various magnitudes.

Variant constructions are naturally possible; in particular, the inside and outside parts 22, 21 or 122 and 121 could be produced by overmolding or even constitute a single part.

The invention claimed is:

1. A bottle-top comprising:

a bottle-top body adapted to be mounted on a bottle, wherein:

said body includes a feed cavity and a top part, the top part is adapted to be moved relative to the body between an inactive configuration wherein a product dispensing orifice is blocked, and an active configuration wherein said dispensing orifice is exposed to an outside and communicates with the feed cavity, the bottle-top comprises a lateral wall formed by the body and, in said inactive configuration, the bottle top comprises an upper wall formed by an upper wall of the top part, the body comprises a concave part-spherical sliding surface which includes a main slot having a plane of symmetry, and the top part comprises a complementary convex part-spherical sliding surface and two parallel flanks that are symmetrical to the plane of symmetry of the main slot and project relative to said convex part-spherical sliding surface, said flanks comprising clipping detents adapted to engage and retain said flanks in said main slot, one of said sliding surfaces comprises said dispensing orifice, said dispensing orifice being symmetrical to the plane of symmetry of the main slot, the dimension of the main slot along the plane of symmetry is adapted so that the main slot remains hidden by the top part in both the inactive and active configurations, and the part-spherical sliding surfaces are adapted to slide one along the other in a relative movement and are connected by complementary retaining and guiding elements that remain hidden by the top part in both the active and inactive configurations.

2. The bottle-top of claim 1, wherein a junction between the lateral and upper walls comprises a circular contour.

3. The bottle-top of claim 2, wherein the lateral wall comprises a circular cylindrical shape.

4. The bottle-top of claim 1, wherein the part-spherical sliding surfaces comprise radii of curvature ranging from half to twice the width of the top part.

5. The bottle-top of claim 1, wherein the main slot is flanked by two secondary slots defining with said main slot two guide rails for the flanks of the top part.

6. The bottle-top of claim 1, wherein the flanks of the top part include shoulders facing the clipping detents and defining grooves for receiving the edges of the main slot.

7. The bottle-top of claim 1, wherein the length of the main slot is at least two thirds the average width of the top part.

8. The bottle-top of claim 1, wherein the bottle-top body further comprises a ramp adapted to be flanked by the flanks of the top part when the top part moves between the active and inactive configurations.

9. The bottle-top of claim 8, wherein:

the ramp is part of a part molded over an inside part of the bottle-top body, the inside part is engaged in an outside part of the body, and the outside part and the top part comprise the outside surface of the bottle-top.

10. The bottle-top of claim 1, wherein:

the dispensing orifice is located in the sliding surface of the top part, the top part includes a dispensing passage terminating at the dispensing orifice and the dispensing passage is configured to communicate with the feed cavity of the body when the top part is in the active configuration.

11. The bottle-top of claim 10, further comprising:

a feed passage within the bottle-top body that is offset relative to the axis of the body, and a dispensing passage of the top part that discharges in an area offset from the axis of the top part.

12. The bottle-top of claim 1, wherein:

the dispensing orifice is located in the sliding surface of the body, and the top part is adapted to move relative to the body in a direction opposite to a movement of the dispensing orifice relative to an axis of the body.

13. The bottle-top of claim 1, wherein the active and inactive configurations of the top part relative to the bottle-top body are determined by complementary bearing surfaces adapted to come into abutting engagement.

14. A bottle adapted to hold a product of liquid or viscous consistency comprising a bottle-top according to claim 1.

* * * * *